US012644622B2

(12) United States Patent
Aly et al.

(10) Patent No.: US 12,644,622 B2
(45) Date of Patent: Jun. 2, 2026

(54) MOTOR FOR FAN OF HVAC SYSTEM

(71) Applicant: Tyco Fire & Security GmbH, Neuhausen am Rheinfall (CH)

(72) Inventors: Amr Aly, Wichita, KS (US); Mason Sloan DeWald, Mulvane, KS (US); Kyeongho Kim, Wichita, KS (US); D'Marcus Letrey Garrett, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 99 days.

(21) Appl. No.: 18/620,854

(22) Filed: Mar. 28, 2024

(65) Prior Publication Data

US 2025/0305708 A1 Oct. 2, 2025

(51) Int. Cl.
*F24F 11/88* (2018.01)
*F24F 11/77* (2018.01)
*F24F 110/10* (2018.01)

(52) U.S. Cl.
CPC ..... *F24F 11/88* (2018.01); *F24F 11/77* (2018.01); *F24F 2110/10* (2018.01)

(58) Field of Classification Search
CPC ..... F24F 11/88; F24F 11/77; F24F 2110/10
See application file for complete search history.

(56) References Cited

U.S. PATENT DOCUMENTS

2011/0140644 A1* 6/2011 Jeung ..... H05K 9/0058 318/400.24
2019/0326840 A1* 10/2019 Beifus ..... H02P 23/0022

* cited by examiner

*Primary Examiner* — Larry L Furdge
(74) *Attorney, Agent, or Firm* — Fletcher Yoder, P.C.

(57) ABSTRACT

A fan motor for a heating, ventilation, and air conditioning (HVAC) system includes a housing and a motor connector integrated with the housing. The motor connector includes a first plurality of ports, a second plurality of ports, and a third plurality of ports. The fan motor is configured to operate in a constant torque mode via the first plurality of ports, and the fan motor is configured to operate in a constant air flow mode via the second plurality of ports instead of the first plurality of ports. The fan motor includes a motor controller configured to operate the fan motor in the constant torque mode in response to energization of at least one port of the first plurality of ports.

20 Claims, 9 Drawing Sheets

MOTOR FOR FAN OF HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control environmental properties by controlling a supply air flow delivered to the environment. For example, the HVAC system may include a fan driven by a motor, where the fan is configured to force the supply air flow across a heat exchanger of a vapor compression circuit to condition the supply air flow. Different types of motors are available for use with HVAC systems. Unfortunately, implementation of a particular type of motor typically involves utilization of a particular configuration of the HVAC system. Indeed, certain motors may be incompatible with certain HVAC system configurations. For example, an HVAC system may lack control components with which certain types of motors are configured to operate certain types of motors. In such cases, selecting an appropriate motor for an HVAC system application may be challenging and costly. Moreover, some HVAC systems may include control components configured for use with one type of motor, but the HVAC system may include another type of motor that does operate utilizing the control components. In such instances, the control components may be unused, thereby adding extraneous costs to the HVAC system.

SUMMARY

In one embodiment, a fan motor for a heating, ventilation, and air conditioning (HVAC) system includes a housing and a motor connector integrated with the housing. The motor connector includes a first plurality of ports, a second plurality of ports, and a third plurality of ports. The fan motor is configured to operate in a constant torque mode via the first plurality of ports, and the fan motor is configured to operate in a constant air flow mode via the second plurality of ports instead of the first plurality of ports. The fan motor includes a motor controller configured to operate the fan motor in the constant torque mode in response to energization of at least one port of the first plurality of ports.

In another embodiment, a heating, ventilation, and air conditioning (HVAC) system includes a fan configured to force an air flow through the HVAC system. The HVAC system also includes a motor configured to drive rotation of the fan. The motor is configured to selectively operate the fan in a constant torque mode and in a constant air flow mode. The motor includes a first plurality of ports configured to receive a first signal directly from a thermostat of the HVAC system to operate the motor in the constant torque mode. Additionally, the motor includes a second plurality of ports configured to receive a second signal to operate the motor in the constant air flow mode.

In a further embodiment, a heating, ventilation, and air conditioning (HVAC) system includes a fan motor configured to drive rotation of a fan to force an air flow across a heat exchanger of the HVAC system. The fan motor includes a housing and a shaft extending from the housing and configured to operably couple to the fan. The fan motor further includes a motor controller disposed within the housing and configured to control operation of the fan motor. The fan motor also includes a motor connector integrated with the housing. The motor connector is electrically coupled to the motor controller and configured to receive a wire harness. Additionally, the motor connector includes a first port configured to receive a thermostat signal directly from a thermostat of the HVAC system and a second port configured to receive a control board signal from a control board of the HVAC system.

DETAILED DESCRIPTION

Figure 1:
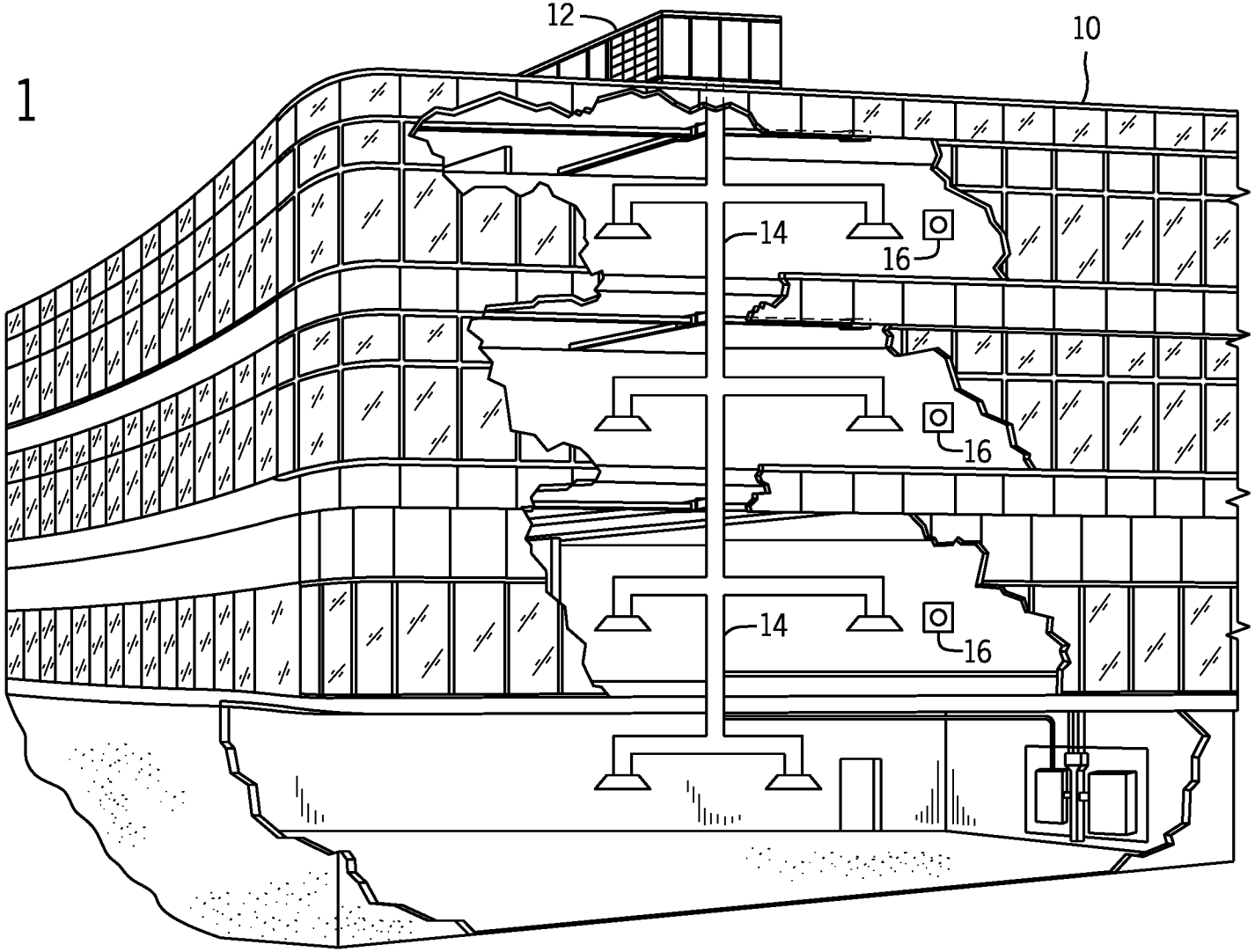
FIG. 1 is a perspective view of an embodiment of a heating, ventilation, and/or air conditioning (HVAC) system for environmental management including an HVAC unit, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor may be used to circulate the working fluid (e.g., refrigerant) through the conduits and other components of the working fluid circuit (e.g., the heat exchangers, an expansion device) and, thus, enable the transfer of thermal energy between components of the working fluid circuit (e.g., between the condenser and the evaporator) and one or more thermal loads (e.g., an environmental air flow, a supply air flow).

In many applications, an HVAC system may be configured to operate based on a call for conditioning (e.g., call for cooling, call for heating) associated with a conditioned space. For example, the HVAC system may be configured to initiate operation to condition and provide a supply air flow to the conditioned space based on a deviation between a measured temperature of the conditioned space and a set point (e.g., desired) temperature of the conditioned space. Some HVAC systems may include a control system having a thermostat configured to receive a user input indicative of the set point temperature, and the thermostat may compare the set point temperature to the measured temperature of the conditioned space and/or other measured temperature indicative of the temperature of the conditioned space. For example, the measured temperature may be received from a sensor, such as a room temperature sensor or a return air sensor.

Based on a determination that the measured temperature deviates from the set point temperature, the control system (e.g., thermostat, control board) may output a signal (e.g., an electrical signal) to initiate operation of the HVAC system. In some embodiments, the signal may be transmitted to one or more components of the HVAC system to initiate operation of the one or more components to enable generation and supply of a conditioned air flow to the conditioned space. For example, the signal may be transmitted toward a motor (e.g., fan motor) of a fan configured to direct an air flow across a heat exchanger (e.g., condenser, evaporator) of the vapor compression circuit. The motor may include a motor connector (e.g., electrical connector, wire connector, harness connector) having ports (e.g., taps, input/output [I/O] ports) configured to receive and/or transmit electrical signals via wires connected to the motor connector. For example, a thermostat and/or a control board of the control system may transmit signals to the motor via the wires connected to the motor connector.

In some cases, the motor may be configured to operate at a constant torque. As will be appreciated, a constant torque motor may be configured to maintain a constant torque (e.g., applied to a shaft of the motor) during operation. Constant torque motors may maintain a constant torque regardless of certain changes in operating conditions of the HVAC system, such as a change in static pressure in the HVAC system. HVAC systems including a constant torque motor may be configured to direct signals from the thermostat to energize one or more ports of the motor connector. That is, the thermostat may output signals (e.g., electrical signals, control signals) directly to the constant torque motor. Some of the ports may correspond to selectable torque values at which the motor is configured to operate. The thermostat may energize one or more of the ports to select the constant torque at which the motor is to operate. Additionally, the thermostat may transmit an activation signal (e.g., "run" signal, on signal) to one or more additional ports of the motor connector of a constant torque motor. As a result, the motor may operate at a selected constant torque in response to receiving the activation signal.

In other cases, the motor may be configured to operate to provide a constant air flow, also referred to as constant cubic feet per minute (CFM). As will be appreciated, a constant air flow motor may be configured to maintain a constant air flow (e.g., volumetric flow rate, CFM) during operation. Constant air flow motors may maintain a constant air flow regardless of certain changes in operating conditions of the HVAC system, such as a change in static pressure in the HVAC system. HVAC systems including a constant air flow motor may include a control board configured to direct signals (e.g., electrical signals, control signals) to the constant air motor to enable and/or control operation of the motor. For example, the control board may be connected to the thermostat and may generate signals to adjust a speed or torque of the motor to maintain a rate of air flow (e.g., volumetric flow rate, constant air flow rate), even as other operating parameters, such as static pressure, of the HVAC system change. The control board may transmit control signals to one or more ports of the motor connector designated and configured to enable constant air flow operation of the motor. The motor may include a motor controller configured to enable two-way communication between the motor and the control board via the motor connector using a particular communication protocol (e.g., constant air flow communication protocol). Instructions for executing the constant air flow communication protocol may be programmed in firmware stored in a memory of the motor controller.

Some HVAC systems may include a motor configured to provide a combination of constant torque and constant air flow operating modes. In such configurations, the HVAC system may include a control board configured to communicate with the motor to enable operation of the motor. The control board is typically included in HVAC systems that have a motor configured to operate in both the constant torque mode and the constant air flow mode, even if the HVAC system is otherwise configured to operate in the constant torque mode alone. Thus, in some instances, the control board may be an extraneous component that increases costs of the HVAC system.

With the foregoing in mind, the present disclosure relates to a fan motor (e.g., motor) for a fan system of an HVAC system having a motor configurable to operate in a constant torque mode, a constant air flow mode, or both (e.g., operate in either mode, operate in a combined mode utilizing constant torque and constant air flow operations). The fan motor includes a motor connector having a first set of ports configured to receive signals from a thermostat to enable operation of the fan motor in the constant torque mode and a second set of ports configured to receive signals from a control board to enable operation of the fan motor in the constant air flow mode. Additionally, the motor includes a third set of ports configured to receive signals in both the constant torque mode and the constant air flow mode. Thus, embodiments of the fan motor described herein may be utilized with HVAC systems configured to operate particularly in the constant torque mode, as well as in HVAC systems configured to operate particularly in the constant air flow mode.

In an embodiment of the HVAC system configured for operation in the constant torque mode, wires may connect the thermostat to the first set of ports and the third set of ports of the motor connector of the fan motor. In such embodiments, the HVAC system may not include a control board that is typically utilized to enable operation in the constant air flow mode, which may enable a reduction in costs associated with manufacture, assembly, operation, and/or maintenance of the HVAC system. In an embodiment of the HVAC system configured for operation in the constant air flow mode, the HVAC system may include the control board, and wires may connect the control board to the second set of ports and the third set of ports of the motor connector of the fan motor. In this way, a common embodiment of the fan motor can be implemented in HVAC systems equipped for constant torque control and in HVAC systems equipped for constant air flow control, while also enabling a reduction in the implementation of extraneous components that would be unused and/or underutilized in certain HVAC system configurations. Thus, present embodiments improve flexibility of the design and manufacturing of HVAC systems and also enable a reduction in costs.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
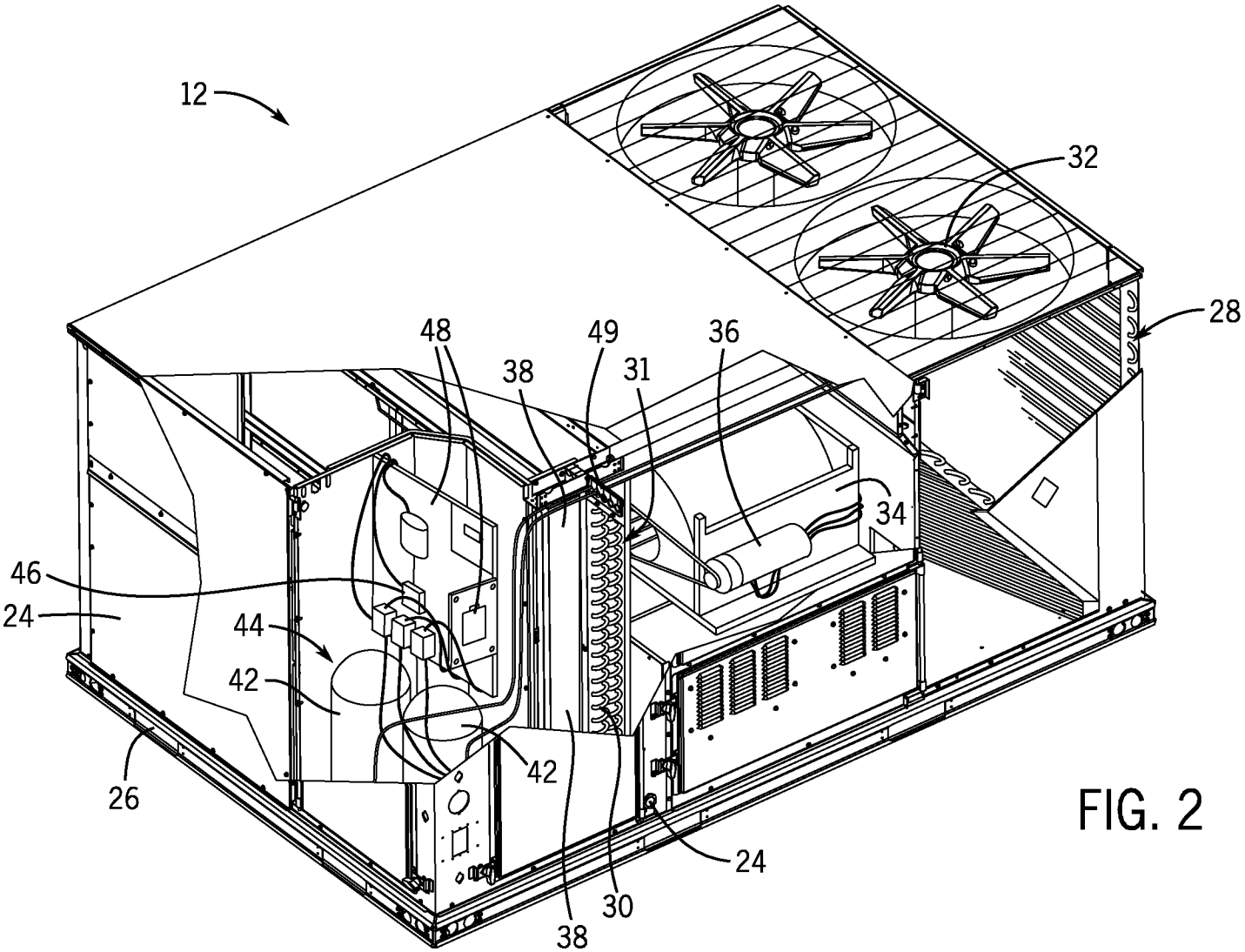
FIG. 2 is a perspective view of an embodiment of a packaged HVAC unit that may be used in an HVAC system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate a working fluid (e.g., refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser in which heat is released from the working fluid to ambient air, and the heat exchanger 30 may function as an evaporator in which the working fluid absorbs heat to cool an air flow (e.g., supply air flow). In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air flow that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to block contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
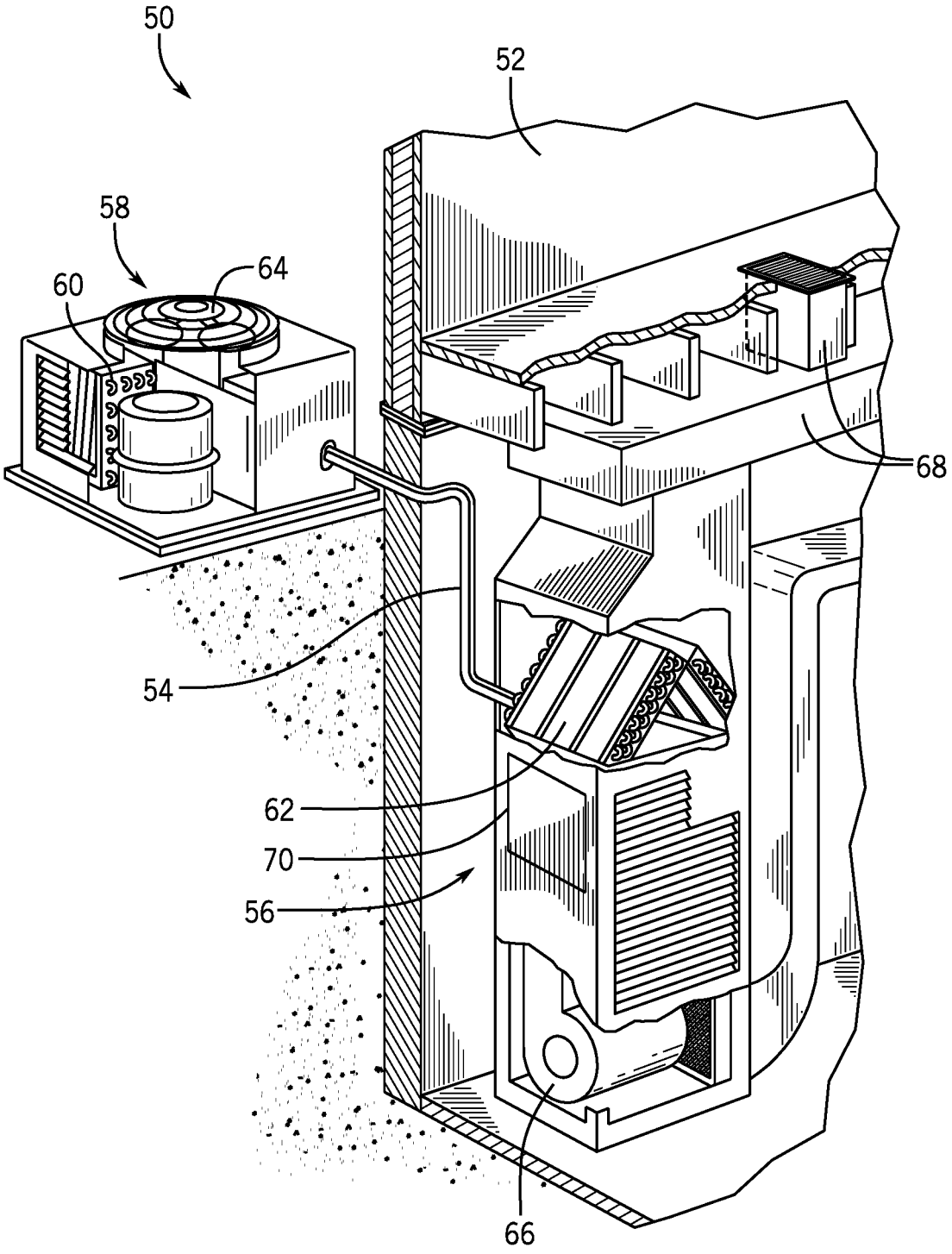
FIG. 3 is a cutaway perspective view of an embodiment of a residential, split HVAC system, in accordance with an aspect of the present disclosure.

FIG. 3 is a perspective view of an embodiment of a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to block leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown across it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
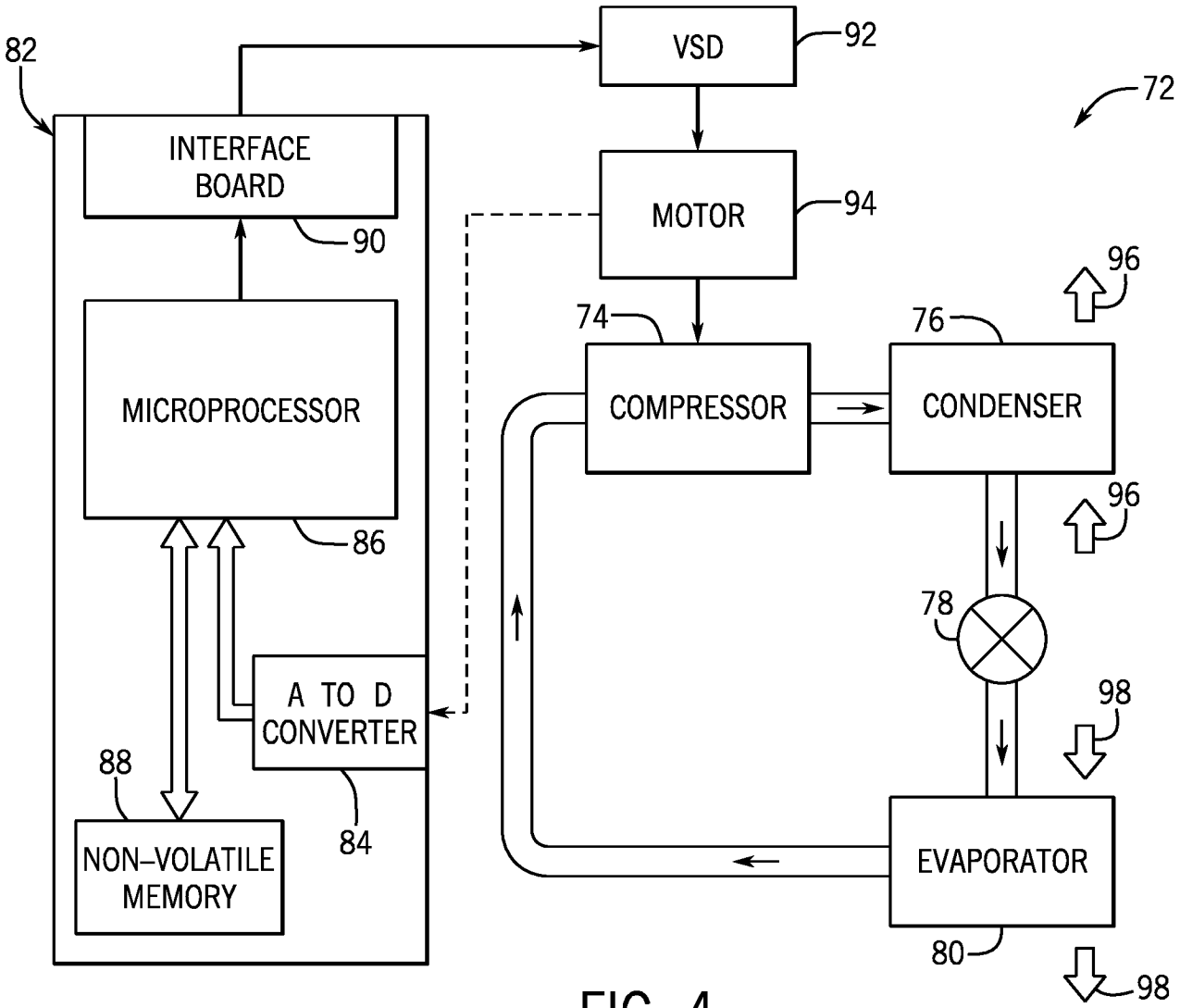
FIG. 4 is a schematic of an embodiment of a vapor compression system that can be used in an HVAC system, in accordance with an aspect of the present disclosure.

FIG. 4 is a schematic of an embodiment of a vapor compression system 72 (e.g., working fluid circuit) that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications. Furthermore, although the discussion below describes the present techniques as incorporated with HVAC systems configurated as a split system (e.g., residential heating and cooling system 50), it should be appreciated that the present techniques may be similarly incorporated in other HVAC system configurations, such as packaged units, rooftop units, air handlers, and so forth. Indeed, any suitable HVAC system having a fan motor configured to drive operation of the fan may incorporate one or more of the features described herein.

As discussed above, embodiments of the present disclosure include a fan motor for a fan system, where the fan motor is configurable to operate in a constant torque mode and in a constant air flow mode. The fan motor includes a motor connector having ports configured to support operation of the fan motor in each of the constant torque mode and the constant air flow mode when connected to a control system of the HVAC system. For example, the motor connector of the fan motor is configured to receive signals from a thermostat (e.g., directly from the thermostat, without an intervening control board) to enable operation of the fan motor in the constant torque mode in embodiments of the HVAC system generally configured for operation in the constant torque mode. Additionally, the motor connector of the fan motor is configured to receive signals from a control board of the HVAC system to enable operation of the fan motor in the constant air flow mode in embodiments of the HVAC system generally configured for operation in the constant air flow mode. Indeed, a common embodiment of the fan motor and/or motor connector described herein may be incorporated in different HVAC systems configured to operate in different modes (e.g., constant torque mode, constant air flow mode) and without incorporation of components that may be extraneous and/or underutilized (e.g., control board) in certain HVAC systems.

Figure 5:
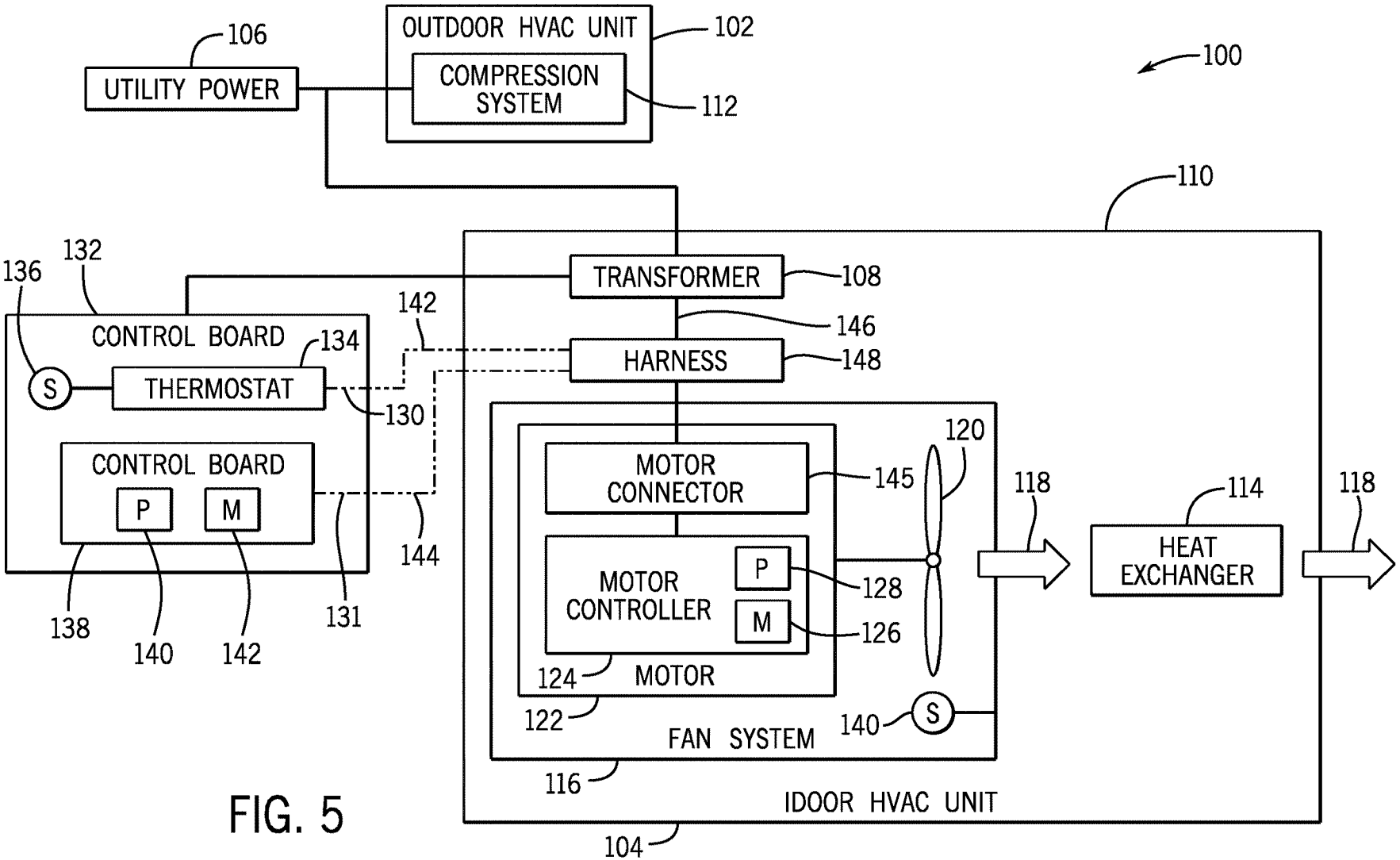
FIG. 5 is a schematic of an embodiment of an HVAC system including an improved fan system, in accordance with an aspect of the present disclosure.

FIG. 5 is a schematic of an embodiment of an HVAC system 100 (e.g., an air conditioner, a heat pump). The HVAC system 100 may include one or more components of the HVAC unit 12, one or more components of the residential heating and cooling system 50, a chiller system, and/or another suitable HVAC system. In the illustrated embodiment, the HVAC system 100 includes an outdoor HVAC unit 102, which may be positioned external to a building, such as in an ambient environment surrounding the building, and an indoor HVAC unit 104, which may be positioned within the building.

The HVAC system 100 may receive utility power from a utility power source 106 (e.g., mains electricity, power grid). The utility power source 106 may supply power at a high voltage (e.g., 120V, 230V). The HVAC system 100 further includes a transformer 108 configured to receive the utility power from the utility power source 106 and step-down the voltage to a range suitable for use by the components of the HVAC system 100. The transformer 108 may be disposed within the indoor HVAC unit 104 as illustrated, or the transformer 108 may be disposed elsewhere, such as in the outdoor HVAC unit 102. The utility power source 106 may also supply power (e.g., high voltage power) to a compressor system 112 disposed within the outdoor HVAC unit 102. As similarly described in detail above, the compressor system 112 may be disposed along a working fluid circuit (e.g., vapor compression system 72, vapor compression circuit) and may be configured to circulate a working fluid (e.g., a refrigerant) therethrough.

The indoor HVAC unit 104 includes a unit housing 110 with a heat exchanger 114 and a fan system 116 disposed therein. The heat exchanger 114 may also be disposed along the working fluid circuit of the HVAC system 100. For example, in a cooling operating mode of the HVAC system 100, the compressor system 112 may discharge the working fluid to a heat exchanger disposed within the outdoor HVAC unit 102 that is configured to operate as a condenser to cool the working fluid. As similarly described above, the cooled working fluid may be directed along the working fluid circuit (e.g., through an expansion device) to the heat exchanger 114 within the indoor HVAC unit 104 that is configured to operate as an evaporator in the cooling operating mode. That is, the heat exchanger 114 may operate as an evaporator to cool an air flow 118 directed across the heat exchanger 114 before the air flow 118 is directed to a conditioned space (e.g., within a building). To this end, the fan system 116 is configured to direct the air flow 118 (e.g., supply air, return air, ambient air) across the heat exchanger 114 to place the air flow 118 and the working fluid within the heat exchanger 114 in a heat exchange relationship. In some embodiments, the fan system 116 may be configured to blow (e.g., push) the air flow 118 across the heat exchanger 114. In other embodiments, the fan system 116 may be configured to draw (e.g., pull) the air flow 118 across the heat exchanger 114. In this way, heat may be transferred from the working fluid to the air flow 118, thereby cooling the working fluid. Although the fan system 116 is shown as a fan system of the indoor HVAC unit 104, it should be appreciated, that the techniques described herein may be implemented with any suitable fan (e.g., outdoor fan, condenser fan, supply air fan, exhaust fan, recirculation fan, in-line duct fan).

The fan system 116 includes a fan 120 and a fan motor 122 (e.g., motor) configured to drive rotation of the fan 120. In this way, the fan 120 may force the air flow 118 across the heat exchanger 114. The fan 120 may be a centrifugal fan, a blower, an axial fan, a mixed flow fan, an in-line fan, or any other suitable type of fan. The fan motor 122 may include a motor controller 124 (e.g., control circuitry) configured to regulate operation of the fan motor 122 and the fan 120. For example, the motor controller 124 may be configured to regulate supply of power to the fan motor 122, process and transmit signals to the fan motor 122, and/or adjust operation of the fan motor 122 to control a speed of the fan 120, a torque of the fan 120, other operating parameters of the fan system 116, or any combination thereof. The fan motor 122 may be a variable speed motor (e.g., electronically commutated motor [ECM]), and the fan system 116 (e.g., motor controller 124) may include a variable speed drive configured to adjust a speed of the fan motor 122, such as based on varying a frequency of power supplied to the fan motor 122.

The motor controller 124 may also include a memory 126 and processing circuitry 128. The processing circuitry 128 may include one or more microprocessors, which may execute software (e.g., executable instructions, code) for controlling components of the fan system 116. The processing circuitry 128 may include multiple microprocessors, one or more "general-purpose" microprocessors, one or more special-purpose microprocessors, and/or one or more application specific integrated circuits (ASICS), or some combination thereof. For example, the processing circuitry 128 may include one or more reduced instruction set (RISC) processors.

The memory 126 (e.g., a memory device) may store information, such as instructions, control software, look up tables, configuration data, code, etc. The memory 126 may include a volatile memory, such as random access memory (RAM), and/or a nonvolatile memory, such as read-only memory (ROM). The memory 126 may store a variety of information and may be used for various purposes. For example, the memory 126 may store processor-executable instructions including firmware or software for the processing circuitry 128 to execute, such as instructions for controlling the fan motor 122 and/or components thereof. In some embodiments, the memory 126 is a tangible, non-transitory, machine-readable medium configured to store machine-readable instructions for the processing circuitry 128 to execute. The memory 126 may include ROM, flash memory, a hard drive, or any other suitable optical, magnetic, or solid-state storage medium, or a combination thereof. The memory 126 may store data, instructions, and any other suitable information. In some embodiments, the memory 126 may store instructions to enable control of the fan motor 122, such as adjusting a speed of the fan motor 122 based on data or feedback received by the motor controller 124. For example, the memory 126 may store firmware for communicating with a thermostat or a control board, and for selecting between operation of the fan motor 122 in the constant torque mode and the constant air flow mode.

Operation of the fan motor 122 may be initiated based on receipt of one or more signals (e.g., thermostat signals 130, control board signals 131) from a control system 132 of the HVAC system 100. The control system 132 includes a thermostat 134, which may be disposed within a conditioned space serviced by the HVAC system 100. The thermostat 134 is configured to receive a user input indicative of a set point operating parameter value (e.g., a set point temperature, a desired temperature, a set point humidity level) for the conditioned space. The thermostat 134 may also be communicatively coupled to a sensor 136 configured to detect an operating parameter value (e.g., measured operating parameter value) indicative of an operating parameter (e.g., temperature, humidity level) within the conditioned space. In some embodiments, the sensor 136 may be positioned within the conditioned space and be configured to detect an operating parameter value (e.g., air temperature, humidity level) within the conditioned space. In other embodiments, the sensor 136 may be positioned within ductwork or within the HVAC system 100 and be configured to detect an operating parameter value of return air received by the HVAC system 100 (e.g., the indoor HVAC unit 104) from the conditioned space.

In operation, the thermostat 134 may compare the set point operating parameter value (e.g., received via user input) and the measured operating parameter value detected by the sensor 136. Based on a determination that the measured operating parameter value deviates from the set point operating parameter value (e.g., by a threshold percentage, by a threshold amount), the thermostat 134 may output one or more thermostat signals 130 (e.g., an electrical signal, a 24 volt [V] signal, call for conditioning signal, call for cooling signal, call for heating signal, call for dehumidification signal) indicative of a call for conditioning. In some embodiments, the thermostat signals 130 may be directly transmitted to the fan motor 122 to enable (e.g., initiate) operation of the fan motor 122. Providing the thermostat signals 130 directly to the fan motor 122 in this manner may enable the fan motor 122 to operate in the constant torque mode and/or block the fan motor 122 from operating in the constant air flow mode. For example, the thermostat signals 130 may cause (e.g., instruct) the fan motor 122 to operate at a particular constant torque without modulating a speed of the fan motor 122, such as based on other operating parameters of the HVAC system 100 (e.g., a pressure of the air flow 118).

In some embodiments, the control system 132 may include a control board 138 operatively integrated with or communicatively coupled to the thermostat 134. The thermostat 134 may transmit the thermostat signals 130 to the control board 138 rather than directly to the motor 122. The control board 138 may include processing circuitry 140 and a memory 142 (e.g., additional processor and additional memory) configured to receive and process the thermostat signals 130 and to generate one or more control board signals 131 to be transmitted to the fan motor 122. Providing the control board signals 131 from the control board 138 to the fan motor 122 in this manner may enable the fan motor 122 to operate in the constant air flow mode and/or block the fan motor 122 from operating in the constant torque mode. For example, the control board signals 131 provided by the control board 138 may cause (e.g., instruct) the fan motor 122 to modulate a speed of the fan motor 122 based on one or more operating parameters of the HVAC system 100, such as feedback from a pressure sensor 140 indicative of a pressure of the air flow 118. The control board 138 is illustrated using dashed lines to signify that some embodiments of the HVAC system 100 may not include the control board 138. Further, it should be appreciated that the control board 138 may be positioned in any suitable location, such as within the indoor HVAC unit 104 (e.g., within the unit housing 110), mounted to an exterior of the unit housing 110, within the outdoor HVAC unit 102, and/or elsewhere within a building serviced by the HVAC system 100.

The HVAC system 100 may include a first electrical path 142 (e.g., one or more first wires), a second electrical path 144 (e.g., one or more second wires), or both configured to enable communication between the control system 132 and the fan motor 122. In embodiments of the HVAC system 100 without the control board 138, the first electrical path 142 may be used to transmit the thermostat signals 130 from the thermostat 134 to (e.g., directly to) the fan motor 122. In such embodiments, the motor 122 may operate in the constant torque mode, and the HVAC system 100 may not include the second electrical path 144, or the second electrical path 144 may not be used during operation of the fan motor 122 in the constant torque mode. On the other hand, in embodiments of the HVAC system 100 having the control board 138, the second electrical path 144 may be used to transmit the control board signals 131 between the control board 138 and the fan motor 122 (e.g., from the control board 138 to the fan motor 122). In such embodiments, the fan motor 122 may be configurable to operate in the constant torque mode, in the constant air flow mode, or both. For example, the motor controller 142 may include instructions (e.g., firmware) to default to operation of the fan motor 122 in the constant air flow mode in response to receiving the control board signals 131 via the second electrical path 144. Additionally or alternatively, the motor controller 142 may include instructions to operate the fan motor 122 in the constant torque mode, regardless of whether the HVAC system 100 includes the control board 138 and/or the first electrical path 142. In any case, the fan motor 122 is configured to receive the thermostat signals 130 and/or the control board signals 131 from the control system 132 via the first electrical path 142 and/or the second electrical path 144, respectively.

The fan motor 122 includes a motor connector 145 (e.g., socket, electrical connector, wire connector, harness connector, integrated connector) electrically (e.g., communicatively) coupled to the motor controller 124 and configured to receive wiring extending from the control system 132, the transformer 108, the thermostat 134, and/or other components of the HVAC system 100. Accordingly, the motor connector 145 is configured to transmit the thermostat signals 130 and/or the control board signals 131 generated by the control system 132 from the control system 132 to the fan motor 122. The motor controller 124 may be electrically coupled to the motor connector 145, such that the motor controller 124 is configured to receive at least a portion of the thermostat signals 130 and/or the control board signals 131. Additionally, the fan motor 122 may receive power from the transformer 108 via a third electrical path 146 (e.g., wires) connected to the motor connector 145. Electromechanical components of the fan motor 122, such as a rotor and/or a stator, may be electrically coupled to the motor connector 145 and configured to receive the power. As discussed in further detail below, the motor connector 145 provides connectivity (e.g., electrically connectivity, communicative coupling) of the fan motor 122 to the thermostat 134, the control board 138, and/or the transformer 108 to enable operation of the fan motor 122 in the constant torque mode and the constant air flow mode.

The HVAC system 100 may further include a harness 148 (e.g., wire harness, wire terminal, crimping apparatus, wire connectors) configured to aggregate and organize wires and/or cables of the first electrical path 142, the second electrical path 144, and/or the third electrical path 146. The harness 148 may bind (e.g., bundle) the wires and cables together and direct each of the wires and cables toward a corresponding terminal point and/or electrical connection of the motor connector 145 in an organized and desired (e.g., expected, standardized) manner or arrangement. Thus, the harness 148 may integrate an otherwise tangled disarray of wires originating from different locations into an ordered connection point whereby each wire may be electrically connected to the motor connector 145.

Generally, the illustrated arrangement of components in different units should be understood as a non-limiting example of a configuration of the HVAC system 100. Although certain components of the HVAC system 100 are shown separated into the outdoor HVAC unit 102 and the indoor HVAC unit 104, it should be appreciated that any or all of these components (e.g., fan system 116, compressor system 112, heat exchanger 114, transformer 108, control system 132) alternatively may be disposed within either the outdoor HVAC unit 102, the indoor HVAC unit 104, or a packaged unit housing 150 without separation between the indoor and the outdoor.

Figure 6:
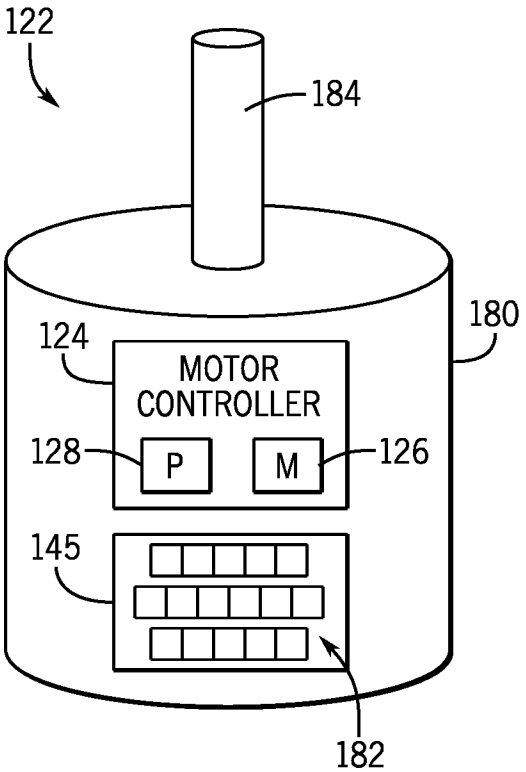
FIG. 6 is a schematic of an embodiment of a motor of an HVAC system, in accordance with an aspect of the present disclosure.

FIG. 6 is a schematic of an embodiment of the fan motor 122 including the motor controller 124 and the motor connector 145. The motor connector 145 may be integrated with (e.g., formed in, secured to, fixedly attached to) a motor housing 180 of the fan motor 122. As such, the motor connector 145 may function as an electrical interface (e.g., electrical pathway) between an exterior of the fan motor 122 (e.g., the motor housing 180) and an interior (e.g., components within the interior) of the motor housing 180. The motor connector 145 includes multiple ports 182 (e.g., I/O ports, taps, electrical connections, pins, terminals) having electrical contacts configured to receive corresponding electrical contacts of a connecting interface (e.g., harness 148, wire connector 192 of FIG. 7) to the motor connector 145. Additionally, the fan motor includes a shaft 184 which may be coupled to the fan 120 to drive rotation of the fan 120. The motor housing 180 also houses internal components of the fan motor 122, such as the motor controller 124, a rotor, a stator, bearings, and gears.

Figure 7:
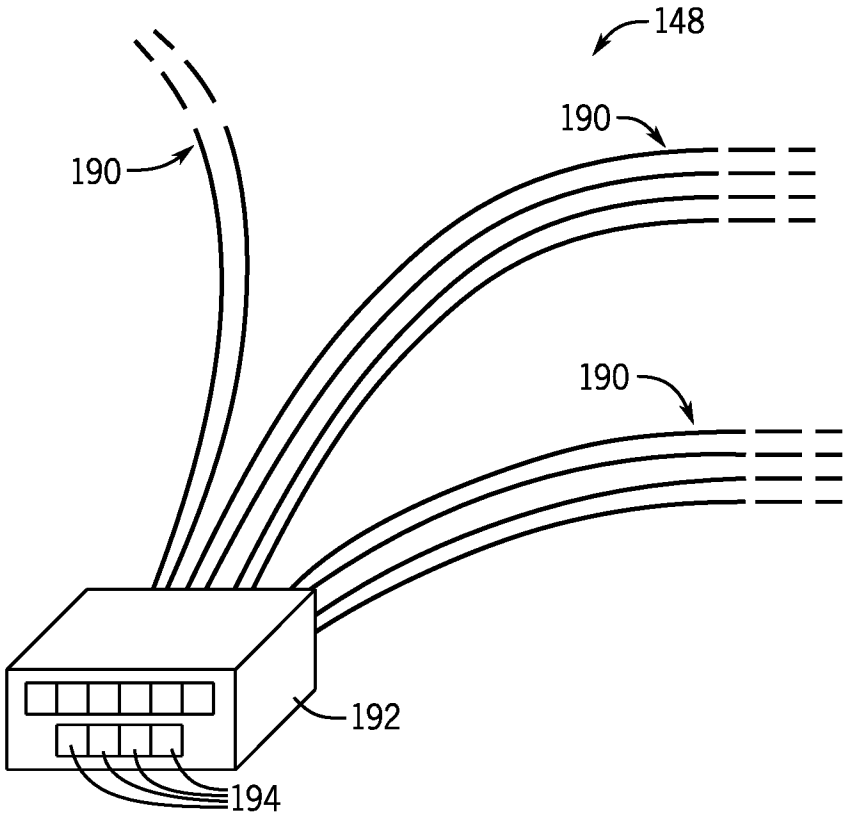
FIG. 7 is a schematic perspective view of an embodiment of a wiring harness for a motor of an HVAC system, in accordance with an aspect of the present disclosure.

FIG. 7 is a schematic of a portion of an embodiment of the harness 148, including wires 190 (e.g., cables) terminating at a wire connector 192 (e.g., housing) of the harness 148. The wire connector 192 may be configured to engage with the motor connector 145. For example, the wire connector 192 may be configured to extend into and/or dock within (e.g., plug into) the motor connector 145. In some embodiments, the wire connector 192 the motor connector 145 may include one or more physical features, such as tabs, shoulders, prongs, ledges, recesses, clips, and/or other surfaces configured to engage with one another to enable secure and removable coupling of the wire connector 192 and the motor connector 145 with one another (e.g., in an engaged configuration).

The wire connector 192 may include multiple terminal points 194 (e.g., pins, terminal connectors, electrical contacts, terminals) that each correspond to a respective one of the wires 190. Each terminal point 194 may be configured to engage with a corresponding one of the ports 182 of the motor connector 145. The harness 148 may bundle one or more respective wires 190 of the first electrical path 142, the second electrical path 144, the third electrical path 144, or a combination thereof. As discussed above, wires 190 of the first electrical path 142 and/or the second electrical path 142 may be excluded, in some embodiments, depending on whether the HVAC system 100 is configured to operate in the constant torque mode or in the constant air flow mode. As such, the wire connector 192 may not include corresponding terminal points 194 for one or more wires 190 extending from the thermostat 134 or for one or more wires 190 extending from the control board 138, depending on a particular configuration and/or intended operation of the HVAC system 100. Indeed, some embodiments of the wire connector 192 may include a fewer number of terminal points 194 than a number of the ports 182 of the motor connector 145. Additionally or alternatively, certain embodiments of the wire connector 192 may include the same number of terminal points 194 as the ports 182 of the motor connector 145, but certain terminal points 194 may not be electrically coupled to a corresponding one of the wires 190. That is, certain terminal points 194 may be electrically isolated, disengaged, or otherwise unused, in some embodiments. Thus, in an engaged configuration (e.g. plugged) of the wire connector 192 with the motor connector 145, some of the ports 182 may remain unplugged or inactive (e.g., electrically disconnected from the wires 190). In some embodiments, the wire connector 192 may include terminal points 194 for any contemplated connection between the wires 190 and the fan motor 122, including terminal points 194 corresponding to each wire 190 of the first electrical path 142, the second electrical path 144, and the third electrical path 146, regardless of whether those wires 190 are actually included in the HVAC system 100. Thus, the wire connector 192 may include as many terminal points 194 as ports 182 of the motor connector 145, and some of the terminal points 194 may remain inactive, such as depending on whether the fan motor 122 and/or the HVAC system 100 is configured to operate in the constant torque mode or the constant air flow mode.

Figure 8:
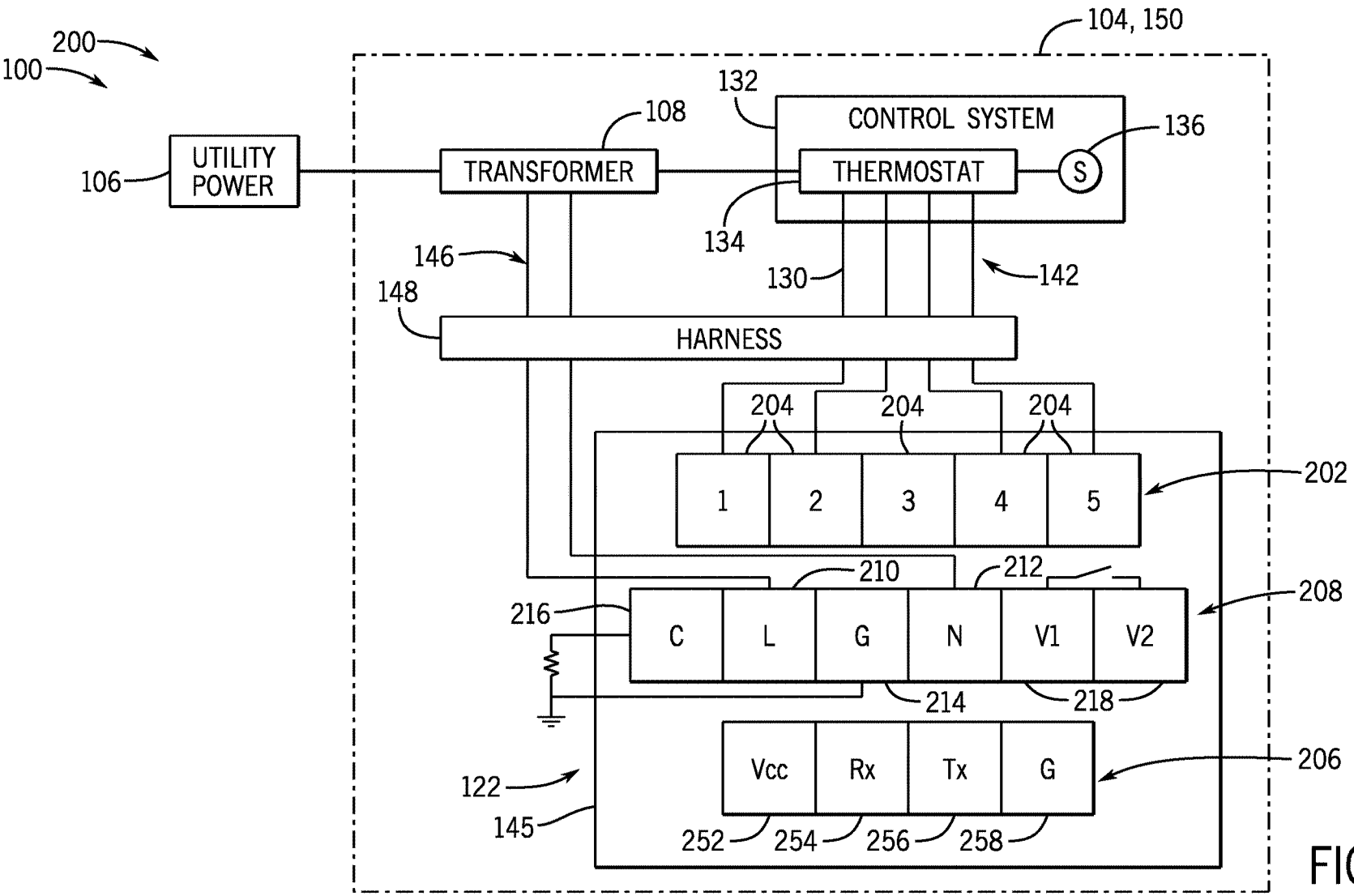
FIG. 8 is a schematic of an embodiment of a portion of an HVAC system including a motor configured to operate in a constant torque mode, in accordance with an aspect of the present disclosure.

FIG. 8 is a schematic of an embodiment of a portion of the HVAC system 100 in a first configuration 200 in which the fan motor 122 is configured to operate in the constant torque mode. For clarity, the motor connector 145 is depicted in FIG. 8 to illustrate a particular wired (e.g., electrically connected) configuration of the fan motor 122, while other components of the fan motor 122 discussed above are omitted. As discussed above, the utility power source 106 may supply power to the transformer 108 of the HVAC system 100. The transformer 108 may be configured to receive the power from the transformer 108 and to step down a voltage of the power to a suitable voltage for operation of components of the HVAC system 100, such as the control system 132 and the fan motor 122.

In the first configuration 200, the control system 132 may not include the control board 138. As such, the thermostat signals 130 are transmitted directly to the motor connector 145 via the first electrical path 142 (e.g., first set of wires). Additionally, power may be transmitted from the transformer 108 to the motor connector 145 via the third electrical path 146 (e.g., power cables, third set of wires). Electrical conduits (e.g., wires, cables) of the first electrical path 142 and the third electrical path 146 may be organized and/or bound together by the harness 148 (e.g., wire harness, wiring assembly, cable harness). For example, the electrical conduits may be sleeved, twisted, and/or bound together by a durable material (e.g., rubber, vinyl, electrical tape, textiles, cable ties) of the harness 148. Additionally, the harness 148 may include terminals or connectors crimped onto the electrical conduits. The electrical conduits may terminate at the wire connector 192, which is configured to engage with the motor connector 145.

The motor connector 145 includes the ports 182, with each port 182 configured to establish an electrical connection (e.g., via one or more of the terminal points 194) to the transformer 108, the thermostat 134, or the control board 138. Although the first configuration 200 of the HVAC system 100 may not include the control board 138, the motor connector 145 may include one or more ports 182 corresponding to the control board 138 to support another configuration of the HVAC system 100. The illustrated embodiment of the motor connector 145 includes three sets (e.g., rows, groups, columns) of the ports 182, with each set having a respective quantity of the ports 182. In other embodiments, the motor connector 145 may include any suitable number of sets or groupings of ports 182 (e.g., 2, 4, or 10) and any suitable number of ports 182 in each set (e.g., 1, 2, 10, 20).

A first set 202 (e.g., first row) of the ports 182 includes multiple speed taps 204. Each speed tap 204 may be programmed to correspond to a respective speed or torque setting of the motor 122. For example, a first speed tap 204 (e.g., labeled "1" in FIG. 8) may correspond to a first torque value, and a second speed tap 204 (e.g., labeled "2" in FIG. 8) may correspond to a second torque value. Each speed setting may be associated with a respective rotational speed of the fan 120 or the shaft 184, a torque output of the shaft 184, and/or a nominal air flow rate of the air flow 118. In some embodiments, one or more of the speed taps 204 may not be programmed to correspond to any speed setting. The thermostat 134 may be configured to energize (e.g., send one of the thermostat signals 130) one of the speed taps 204 (e.g., a selected port 182) at a time. In this way, the thermostat signals 130 causes the fan motor 122 to run at a constant speed setting corresponding to the energized speed tap 204.

A second set 206 (e.g., second row) of the ports 182 may include communication pins configured to connect to the control board 138. In the first configuration 200, the second set 206 of ports 182 may be inactive or disconnected, as the HVAC system 100 may be configured to operate in the first configuration 200 and with the fan motor 122 in the constant torque mode without the control board 138. The second set 206 of the ports 182 is discussed in detail below with reference to FIG. 9.

A third set 208 (e.g., third row) of the ports 182 may include power supply pins (e.g., power connection pins, power circuit pins, electrical circuit pins) configured to provide power to the motor 122. The power may be high voltage power (e.g., 230V) supplied by the utility power source 106. For example, the second electrical path 146 may extend from a high voltage section of the transformer 108 to the third set 208 of the ports 182. The power supply pins may include a line voltage pin 210 configured to receive power from the transformer 108 or the utility power supply 106. The power supply pins may also include a neutral pin 212 configured to carry a return current to the transformer 108, the utility power supply 106, or the earth. Thus, the voltage of the line voltage pin 210 may be defined relative to zero volts at the neutral pin 212. The power supply pins may further include a ground pin 214 connected to ground (e.g., the earth). Additionally, the power supply pins may include a common pin 216 configured to provide a connection to a common voltage (e.g., 24V). Furthermore, the power supply pins may include a pair of voltage setting pins 218 configured to establish voltage setting of the power to the motor. In a configuration in which the voltage setting pins 218 are not connected, the fan motor 122 may be configured to operate utilizing a first input voltage (e.g., 230V). In a configuration in which the voltage setting pins 218 are shorted, the fan motor 122 may be configured to operate utilizing a second input voltage (e.g., 115V). For example, a jumper wire may be installed to electrically connect the voltage setting pins 218 to each other, causing the fan motor 122 to be configured to operate using the second input voltage. The voltage setting may be selected based on a voltage rating of the fan motor 122.

Figure 9:
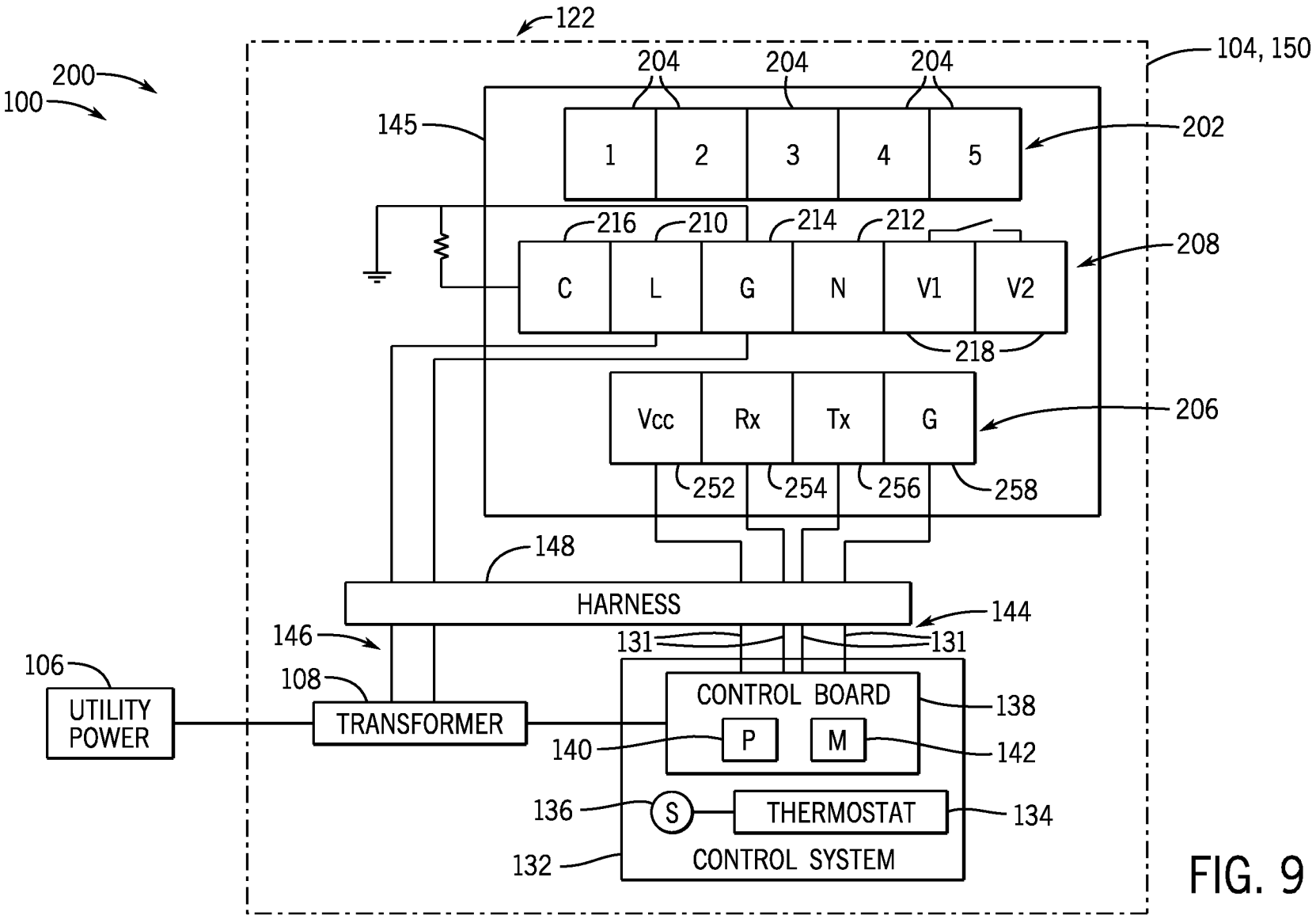
FIG. 9 is a schematic of an embodiment of a portion of an HVAC system including a motor configured to operate in a constant air flow mode, in accordance with an aspect of the present disclosure.

FIG. 9 is a schematic of an embodiment of a portion of the HVAC system 100 in a second configuration 250 in which the fan motor 122 is configured to operate in the constant airflow mode. While the embodiment of the motor connector 145 illustrated in FIG. 7 may be the same or similar as the motor connector 145 shown in FIG. 8, the electrical connections established by the motor connector 145 (e.g., via connection to the harness 148) differ between the first configuration 200 and the second configuration 250. In the second configuration 250, the first set 202 of the ports 182 may be inactive or disconnected. Thus, the thermostat 134 may not transmit the thermostat signals 130 directly to the fan motor 122. Instead, the thermostat 134 may transmit the thermostat signals 130 or other additional signal(s) to the control board 138, and the control board 138 may transmit the control board signals 131 to the fan motor 122 via the second electrical path 144, the harness 148, the wire connector 192 (e.g., terminal points 194), and the motor connector 145 (e.g., ports 182).

In the second configuration 250, the control board 138 may transmit the control board signals to the second set 206 of the ports 182. As mentioned above, the second set 206 includes communication pins configured to enable communication between the fan motor 122 and the control board 138. For example, the communication pins may include a supply voltage pin 252 configured to supply an input voltage to the fan motor 122. The input voltage may be used to power the motor controller 124 (e.g., processing circuitry 128) and/or other parts of the fan motor 122. Additionally, the communication pins may include a signal input pin 254 configured to receive the control board signals 131 transmitting instructions to adjust a speed, torque, and/or power of the fan motor 122 to maintain a desired air flow (e.g., constant air flow). The control board signals 131 provided to the signal input pin 254 may include instructions beyond mere on/off commands that may be provided to the speed taps 204 in the first configuration 200. For example, the control board signals 131 provided to the signal input pin 254 may include a pulse-width-modulation (PWM) signal, a sequence of signals (e.g., a script), a prescription of power output as a function of time, and so on. The control board signals 131 may be processed by the motor controller 124 (e.g., processing circuitry 128) based on firmware stored in in the motor controller 124 (e.g., memory 126). The motor controller 124 may modulate (e.g., adjust, regulate) power to the fan motor 122 based on the processed control board signals 131. In some embodiments, the motor controller 124 may modulate the power to the fan motor 122 based on feedback indicative of operating parameters of the HVAC system 100, such as a pressure of the air flow 118 (e.g., as measured by the pressure sensor 140). Processing of the feedback and/or calculations related to the modulation of the power may be performed by the motor controller 124 (e.g., processing circuitry 128), the control board 138 (e.g., processing circuitry 140), the thermostat 134, and/or another suitable processor of the HVAC system 100.

The communication pins may further include a signal output pin 256 configured to transmit data and/or feedback from the fan motor 122 to the control board 138. For example, the motor controller 124 may monitor operating parameters (e.g., current draw, power output, temperature) of the fan motor 122 and provide feedback regarding the monitored operating parameters to the control board 138 via the signal output pin 256. Additionally, the second set 206 of the ports 182 may include a ground pin 258 configured to connect to a ground (e.g., ground point).

In the second configuration 250, the third set 208 of the ports 182 (e.g., power supply pins) may be connected in a similar manner as in the first configuration 200. For example, the line voltage pin 210 and the neutral pin 212 may be connected to the high voltage side of the transformer 108 or the utility power source 106. In this way, the fan motor 122 may receive high voltage power (e.g., 230V) to power the fan motor 122.

The constant torque mode and the constant air flow mode may be implemented using different communication protocols between the fan motor 122, the control board 138, and/or the thermostat 134. To this end, the motor controller 124 may automatically switch between the different communication protocols based on a determination of whether the constant torque mode or the constant air flow mode is desired and/or to be implemented. For example, the motor controller 124 may detect that one of the speed taps 204 (e.g., a selected port 182) is energized, indicating that the thermostat 134 is configured (e.g., electrically connected, directly electrically connected) to transmit the thermostat signals 130 to the fan motor 122. Then, the motor controller 124 may initiate or switch to a first communication protocol corresponding to the constant torque mode. In another instance, the motor controller 124 may detect that one of the communication pins (e.g., the voltage supply pin 252, the signal input pin 254) is receiving input from the control board 138. Then, the motor controller 124 may initiate or switch to a second communication protocol corresponding to the constant air flow mode. In this way, the motor 122 may be configured to selectively operate the fan 120 in a constant torque mode and in a constant air flow mode.

In some cases, the control system 132 may connect to both the first set 202 of the ports 182 and the second set 206 of the ports 182. For example, the HVAC system 100 may include both the first electrical path 142 and the second electrical path 144, such that the thermostat 134 and the control board 138 are each electrically and/or communicatively connected to the motor connector 145. The motor controller 124 may default to one of the constant torque mode or the constant air flow mode based on a predetermined setting. Additionally, the motor controller 124 may determine the appropriate operating mode based on other input, such as sensor feedback, user input, and/or signals from the control system 132 (e.g., control board signals 131).

In some embodiments, the motor connector 145 and the harness 148 (e.g., wire connector 192) may have corresponding (e.g., standardized, common, shared, matching) geometries (e.g., layout, pinout) such that the motor connector 145 is configured to receive the wire connector 192 in both the first configuration 200 and the second configuration 250. For example, the wire connector 192 may have a same spatial footprint in the first configuration 200 as in the second configuration 250 although the electrical connections between the terminal points 194 and the ports 182 may differ. In this way, the harness 148 and the motor connector 145 may be compatible with one another whether the fan motor 122 is configured to operate in the constant torque mode or in the constant air flow mode.

Figure 10:
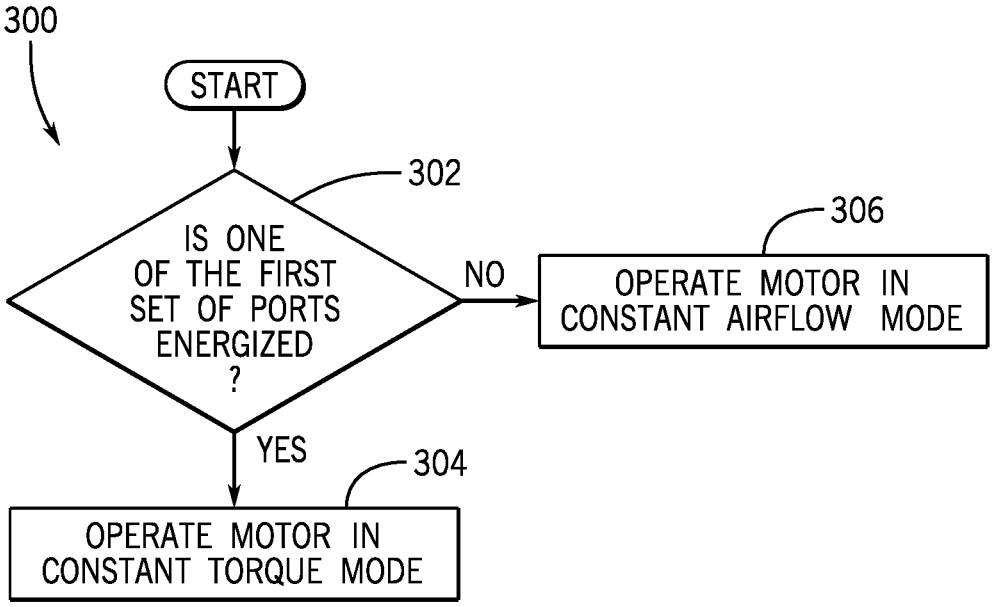
FIG. 10 is a flow chart of an embodiment of a method of operating a motor of an HVAC system, in accordance with an aspect of the present disclosure.

FIG. 10 is a flow chart of an embodiment of a method 300 of operating the fan system 116, in accordance with the present techniques (e.g., selecting between a constant torque mode and the constant air flow mode). The method 300 may be performed by the motor controller 124 (e.g., processing circuitry 128). At block 302, the motor controller 124 may determine whether one or more of the ports 182 of the first set 202 of the ports 182 (e.g., speed taps 204) are energized. If so, then, at block 304, the motor controller 124 may proceed to operate the fan motor 122 in the constant torque mode. For example, the motor controller 124 may initiate or switch to the first communication protocol to communicate (e.g., directly communicate) with the thermostat 134. If, at block 302, the motor controller 124 determines that one or more of the ports 182 of the first set 202 of the ports 182 (e.g., speed taps 204) are not energized (e.g., none of the ports 182 of the first set 202 is energized), then the motor controller 124 may proceed at block 306 to operate the fan motor 122 in the constant air flow mode. For example, the motor controller 124 may initiate or switch to the second communication protocol to communicate with the control board 138. In this way, the motor 122 may be configured to selectively operate the fan 120 in a constant torque mode and in a constant air flow mode.

Figure 11:
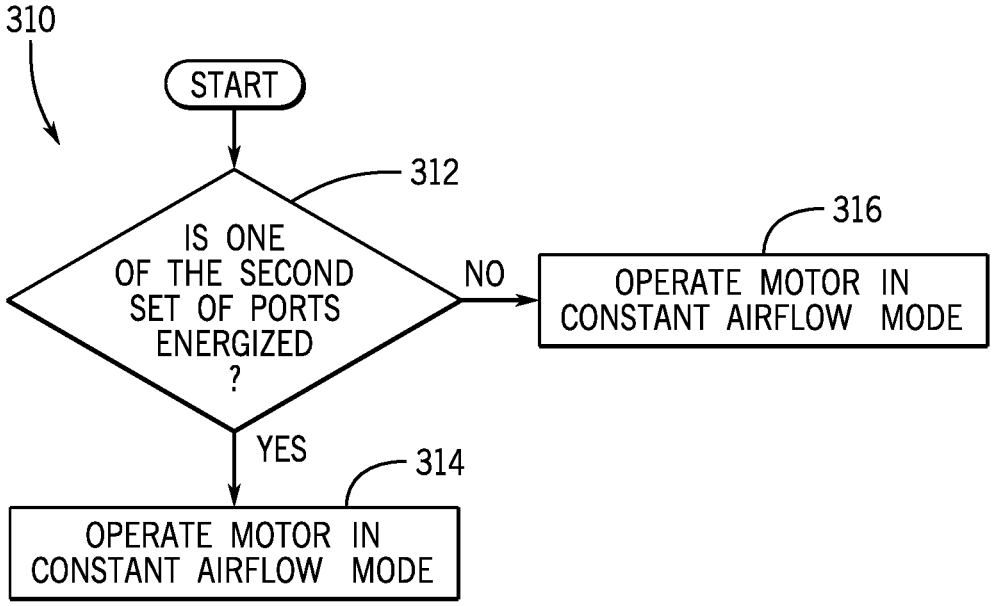
FIG. 11 is a flow chart of an embodiment of a method of operating a motor of an HVAC system, in accordance with an aspect of the present disclosure.

FIG. 11 is a flow chart of an embodiment of a method 310 of operating the fan system 116, in accordance with the present techniques (e.g., selecting between a constant torque mode and the constant air flow mode). The method 310 may be performed by the motor controller 124 (e.g., processing circuitry 128). At block 312, the motor controller 124 may determine whether one or more of the ports 182 of the second set 206 of the ports 182 (e.g., communication pins) are energized. If so, then, at block 314, the motor controller 124 may proceed to operate the fan motor 122 in the constant air flow mode. For example, the motor controller 124 may initiate or switch to the second communication protocol to communicate with the control board 138. If, at block 312, the motor controller 124 determines that one or more of the ports 182 of the second set 206 of the ports 182 (e.g., communication pins) are not energized, then the motor controller 124 may proceed at block 316 to operate the motor 122 in the constant torque mode. For example, the motor controller 124 may initiate or switch to the first communication protocol to communicate with the thermostat 134. In this way, the motor 122 may be configured to selectively operate the fan 120 in a constant torque mode and in a constant air flow mode.

As described in detail above, embodiments of the present disclosure are directed to a fan motor of an HVAC system that is configured to selectively operate in a constant torque mode and a constant air flow mode. The fan motor includes a motor connector having a first set of ports configured to receive thermostat signals directly from a thermostat, a second set of ports configured to receive control board signals from a control board, and a third set of ports configured to receive power from a transformer or a utility power source. The fan motor includes a motor controller configured to operate the fan motor in the constant torque mode based on (e.g., in response to) receipt of the thermostat signals received via the first set of ports. Additionally, the fan motor may operate in the constant air flow mode based on (e.g., in response to) receipt of the control board signals received via the second set of ports. In both the constant torque mode and the constant air flow mode, the fan motor may receive the power from the transformer or the utility power source. In this way, the fan motor may be used in a wide variety of HVAC systems. For example, the fan motor, though configure to operate in the constant air flow mode, may also operate in HVAC systems without a control board that supports the constant air flow mode.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A fan motor for a heating, ventilation, and air conditioning (HVAC) system, comprising:

a housing;

a motor connector integrated with the housing, wherein the motor connector comprises a first plurality of ports, a second plurality of ports, and a third plurality of ports, the fan motor is configured to operate in a constant torque mode via the first plurality of ports, and the fan motor is configured to operate in a constant air flow mode via the second plurality of ports instead of the first plurality of ports; and a motor controller configured to operate the fan motor in the constant torque mode in response to energization of at least one port of the first plurality of ports.

2. The fan motor of claim 1, wherein the motor controller is configured to operate the motor in the constant air flow mode in response to energization of at least one port of the second plurality of ports.

3. The fan motor of claim 1, wherein the first plurality of ports is configured to establish a speed setting of the fan motor based on energization of a selected port of the first plurality of ports, the second plurality of ports is configured to communicatively couple to a control board of the HVAC system, and the third plurality of ports comprises a power supply pin configured to receive power to drive the fan motor.

4. The fan motor of claim 3, wherein the second plurality of ports comprises a signal input pin configured to receive instructions from the control board to adjust a speed of the fan motor.

5. The fan motor of claim 3, wherein the fan motor is configured to receive the power via the power supply pin in the constant torque mode and in the constant air flow mode.

6. The fan motor of claim 3, wherein the motor is configured to receive thermostat signals directly from a thermostat of the HVAC system via the first plurality of ports.

7. The fan motor of claim 1, wherein the first plurality of ports is arranged in a first row, the second plurality of ports is arranged in a second row, and the third plurality of ports is arranged in a third row.

8. A heating, ventilation, and air conditioning (HVAC) system, comprising:

a fan configured to force an air flow through the HVAC system;

a motor configured to drive rotation of the fan, wherein the motor is configured to selectively operate the fan in a constant torque mode and in a constant air flow mode, wherein the motor comprises:

a first plurality of ports configured to receive a first signal directly from a thermostat of the HVAC system to operate the motor in the constant torque mode; and a second plurality of ports configured to receive a second signal to operate the motor in the constant air flow mode.

9. The HVAC system of claim 8, wherein the second plurality of ports is configured to receive the second signal from a control board of the HVAC system, and the control board is configured to receive an additional signal from the thermostat.

10. The HVAC system of claim 8, wherein the motor comprises a third plurality of ports configured to receive power from a transformer of the HVAC system, and the motor is configured to drive the rotation of the fan utilizing the power.

11. The HVAC system of claim 10, wherein the motor comprises a motor connector, and the first plurality of ports, the second plurality of ports, and the third plurality of ports are arranged within the motor connector.

12. The HVAC system of claim 11, wherein the motor comprises a housing, and the motor connector is integrated with the housing.

13. The HVAC system of claim 8, wherein the motor comprises a motor controller, and the motor controller is configured to operate the motor utilizing a first communication protocol in response to receipt of the first signal via the first plurality of ports.

14. The HVAC system of claim 13, wherein the motor controller is configured to operate the motor utilizing a second communication protocol in response to receipt of the second signal via the second plurality of ports.

15. The HVAC system of claim 14, wherein the fan is a centrifugal fan configured to force a supply air flow through the HVAC system as the air flow.

16. A heating, ventilation, and air conditioning (HVAC) system, comprising:

a fan motor configured to drive rotation of a fan to force an air flow across a heat exchanger of the HVAC system, wherein the fan motor comprises:

a housing;

a shaft extending from the housing and configured to operably couple to the fan;

a motor controller disposed within the housing and configured to control operation of the fan motor; and a motor connector integrated with the housing, wherein the motor connector is electrically coupled to the motor controller, the motor connector is configured to receive a wire harness, and the motor connector comprises a first port configured to receive a thermostat signal directly from a thermostat of the HVAC system and a second port configured to receive a control board signal from a control board of the HVAC system.

17. The HVAC system of claim 16, wherein the first port is arranged in a first row of ports, the second port is arranged in a second row of ports, and the third port is arranged in a third row of ports.

18. The HVAC system of claim 16, wherein the motor controller is configured to:

operate the motor in a constant torque mode in response to receipt of the thermostat signal; and operate the motor in a constant air flow mode in response to receipt of the control board signal.

19. The HVAC system of claim 18, wherein the motor connector comprises a third port configured to receive a supply of power from a transformer of the HVAC system in the constant torque mode and in the constant air flow mode, and the motor is configured to drive the rotation of the shaft utilizing the supply of power in the constant torque mode and in the constant air flow mode.

20. The HVAC system of claim 19, comprising the wire harness, wherein the wire harness comprises a first terminal corresponding to the first port, a second terminal corresponding to the second port, and a third terminal corresponding to the third port.

* * * * *